United States Patent [19]

Bandy

[11] 4,257,490

[45] Mar. 24, 1981

[54] PORTABLE OBSERVATION STAND

[76] Inventor: Irvin C. Bandy, 614 E. Swayzee St., Marion, Ind. 46952

[21] Appl. No.: 46,452

[22] Filed: Jun. 7, 1979

[51] Int. Cl.[3] ..... E06C 7/48; E06C 1/08

[52] U.S. Cl. ..... 182/116; 182/163; 182/187; 182/189; 182/206

[58] Field of Search ..... 182/116, 187, 163, 164, 182/100, 189, 93, 95, 206

[56] References Cited

U.S. PATENT DOCUMENTS

| | | | |
|---|---|---|---|
| 234,389 | 11/1880 | Cannon | 182/189 |
| 439,361 | 10/1890 | Stupp | 182/189 |
| 818,268 | 4/1906 | Leuz | 182/116 |
| 2,183,251 | 12/1939 | Beggs | 182/163 |
| 3,057,431 | 10/1962 | George | 182/163 |
| 3,419,108 | 12/1968 | Mobbs | 182/187 |
| 4,009,763 | 3/1977 | Hunter | 182/187 |
| 4,061,202 | 12/1977 | Campbell | 182/116 |

*Primary Examiner*—Reinaldo P. Machado

*Attorney, Agent, or Firm*—Woodard, Weikart, Emhardt & Naughton

[57] ABSTRACT

A portable observation stand mountable to a tree. A ladder includes a plurality of tubular sections pivotally interconnected. A platform pivotally mounted to the top of the ladder is abuttable against a tree and secured thereto by a chain having a first end attached to the platform with the chain then extending around the tree to a hook pivotally mounted to the platform. Means are provided to tighten the chain. Temporary erecting means mounted to the stand secures the platform in a horizontal position until the chain is tightened.

6 Claims, 4 Drawing Figures

PORTABLE OBSERVATION STAND

BACKGROUND OF THE INVENTION

This invention is in the field of portable and erectable observation stands and more particularly those stands attachable to a tree such as a hunting stand. Several tree stands have heretofore been invented including those disclosed in the following U.S. Pat. Nos. 3,057,431 issued to J. R. George; 3,630,314 issued to Milton D. Bamburg et al; 4,061,202 issued to Donald E. Campbell and 4,134,474 issued to Harold L. Stavenau et al.

The portable observation stand disclosed herein is particularly advantageous as compared to the prior stands in that the stand may be easily erected and attached to a tree. Typically, the prior erected stands utilize a ladder having a top end resting against and attached to the tree. A platform may be pivoted to the top end of the ladder and as a result, difficulty is encountered by a person standing on the ladder and at the same time trying to hold the platform in a horizontal position while attaching the platform to the tree. The stand disclosed herein is provided with a device which temporarily holds the platform in a horizontal position while the platform is being attached to the tree with the device then pivoting out of the way once the platform is rigidly attached in the horizontal position. Alternative mechanisms for holding the platform horizontal prior to attachment result in bulky designs and increased weight therefore reducing the portability of the stand.

The stands may be used for many purposes including hunting and observation. It is therefore desirable to provide a design wherein a person may either sit or stand atop the platform. The platform disclosed herein is particularly advantageous over the prior stands in that a seat is provided atop the platform which may be pivoted to one side of the platform when not in use therefore allowing a person to have full access to the top surface of the platform.

It can be appreciated that it is desirable to be able to attach the observation platform to trees of different sizes. Many of the prior observation stands are designed to rest against trees with a limited range of diameters. The stand disclosed herein is provided with means which will allow attachment to a tree of relatively small diameter as well as a tree of relatively large diameter.

SUMMARY OF THE INVENTION

One embodiment of the present invention is a portable observation stand comprising a collapsable ladder with a base supporting bottom portion and a top portion; a platform mounted pivotally to the top portion of the ladder and including a tree embracing edge and a top surface; a flexible line with one end attached to the platform and an opposite free end and having sufficient length to extend around a tree; tightening means engagable with said free end of the line and operable to pull the line tight to force the tree embracing edge against a tree; and a platform erecting means mounted on the ladder and engagable with the platform operable to hold the platform horizontally until secured to a tree by the line and tightening means.

It is an object of the present invention to provide a new and improved portable observation stand restable against and attachable to a tree.

A further object of the present invention is to provide a tree stand including a platform designed to allow a person to assume either a sitting or a standing position.

In addition, it is an object of the present invention to provide a portable tree stand which may be readily attached to a tree with minimum effort.

Related objects and advantages of the present invention will be apparent from the following description.

DESCRIPTION OF THE PREFERRED EMBODIMENT

Figure 4:
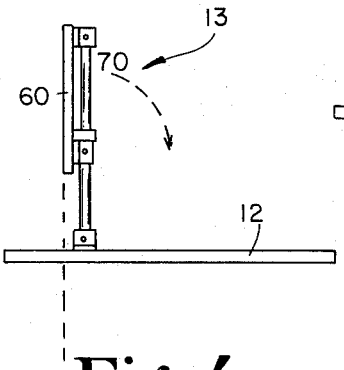
FIG. 4 is a fragmentary side view of the platform with the seat shown in the upward stored position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
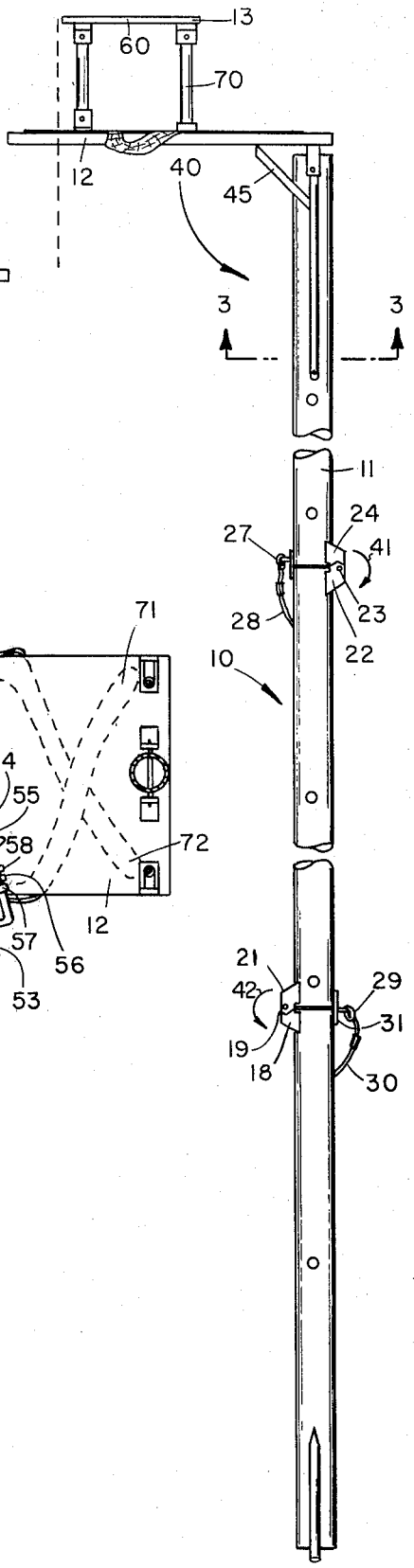
FIG. 2 is a fragmentary side view of the tree stand of FIG. 1.
Figure 1:
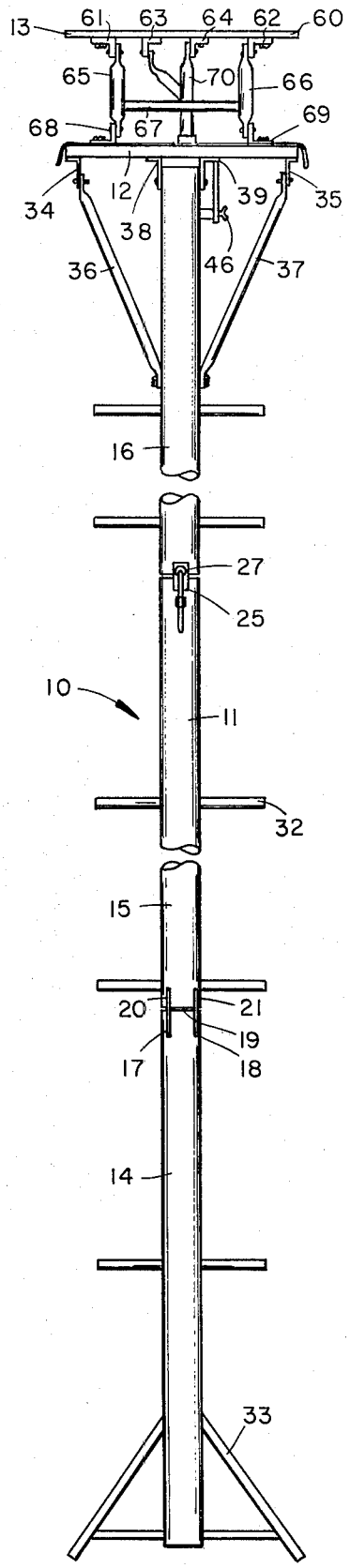
FIG. 1 is a fragmentary rear view of a tree stand incorporating the present invention.

Referring now more particularly to FIGS. 1 and 2, there is shown a portable observation stand 10 including a collapsible ladder 11 attached to platform 12 including a seat 13 mounted thereatop. Ladder 11 is composed of a plurality of tubular sections such as sections 14, 15 and 16 interconnected together. For example, section 14 includes a top end having a pair of arms 17 and 18 pivotally connected by pin 19 to a pair of arms 20 and 21 fixedly attached to the bottom end of section 15. Likewise, the top end of section 15 includes a pair of arms 22 fixedly attached thereto and pivotally connected by pin 23 to a pair of arms 24 fixedly attached to the bottom end of section 16. On the side of the section opposite the pivotally interconnected arms is provided a tab through which a threaded member extends so as to lockingly secure the sections together. For example, tab 25 is fixedly connected to the top end of section 15 and extends upwardly adjacent the bottom end of section 16 having a hole alignable with a threaded hole provided in section 16. Thus, a threaded member 27 is extendable through the hole in tab 25 and into the threaded hole provided in section 16 to lockingly secure tab 25 to section 16 and therefore lockingly secure sections 15 and 16 together. A flexible cord or a line 28 is attached to the head of threaded member 27 with the opposite end of line 28 attached to section 15 by any number of means. In the embodiment shown in the drawing, line 28 extends into a hole provided in section 15 with the line having an enlarged end to prevent line 28 from disengaging section 15 and while simultaneously allowing threaded member 27 to be rotated with line 28. A similar threaded member 29 is mounted by line 30 to section 14 and extends through tab 31 fixedly attached to section 14 and alignable with a threaded hole provided in the bottom end of section 15. Thus, threaded member 29 extends through tab 31 and into section 15 thereby securing the tab to section 15 and locking sections 14 and 15 together. It will be noted that the tab and threaded member for sections 14 and 15 are located on a side opposite the tab and threaded member securing sections 15 and 16 together. By positioning the tabs and threaded members on opposite sides, greater stability is achieved.

A plurality of foot holds or rungs 32 are cantileveredly mounted to sections 14, 15 and 16 and project outwardly from the opposite sides thereof to allow a person to climb upwardly towards platform 12. A tripod frame 33 is mounted to the bottom end of section 14 to provide a suitable base for the ladder.

Figure 3:
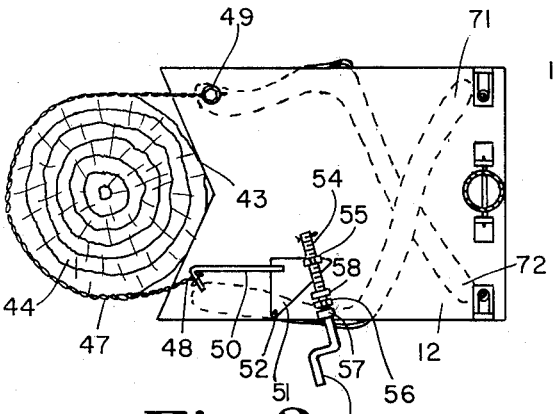
FIG. 3 is a cross-sectional view taken along line 3—3 of FIG. 2 and viewed in the direction of the arrows.

A first pair of L-shaped brackets 34 and 35 are fixedly attached to the bottom surface of platform 12 and in turn are pivotally attached to the top ends of a pair of upwardly extending members 36 and 37 having bottom ends fixedly attached to section 16. A second pair of L-shaped members 38 and 39 are fixedly attached to the bottom surface of platform 12 and in turn are pivotally attached to the top end section 16. Platform 12 may be swung downwardly in the direction of arrow 40 (FIG. 2) while section 16 may be pivoted in the direction of arrow 41 and sectin 15 may be pivoted in the direction of arrow 42 thereby allowing the ladder to be collapsed along with platform 12. Pins 27 and 29 are first removed prior to pivoting sections 14 through 16. In order to erect the ladder and platform, sections 14 through 16 are pivoted until aligned and in a straight line with threaded members 27 and 29 then being threadedly inserted into their respective sections. Next, the ladder is positioned so that the base 33 of the ladder is located immediately adjacent to the tree trunk with platform 12 then being pivoted upwardly to the horizontal position with the V-shaped edge 43 (FIG. 3) of the platform abuttingly engaging the tree trunk 44. Member 45 is then pivoted upwardly until the top end of the member abuttingly engages the bottom surface of platform 12 to temporarily secure the platform in a horizontal position. The bottom end of member 45 is pivotally connected by a conventional fastening device 46 to the top end of section 16. Member 45 provides a platform erecting means which is mounted to the ladder and engagable with the platform to hold the platform horizontally until the platform is secured to the tree by flexible line 47 (FIG. 3).

Flexible line 47 may take the form of a chain having a first end attached by a conventional fastening device 49 to the bottom surface of platform 12. Chain 47 is then positioned around the opposite side of the tree with the opposite end 48 of the chain being hookingly engaged by an L-shaped hook member 50 having its opposite end pivotally mounted to plate 51 in turn pivotally mounted to the bottom surface of platform 12 by a conventional fastening device 52. A tightening means 53 is provided to engage the free end 48 of chain 47 and operable to pull the line tight thereby forcing edge 43 against tree 44. The tightening means may take the form of a crank having a threaded main body 54 which is in meshing engagement with an internally threaded ring 55 fixedly mounted to plate 51. Main body 54 extends freely through bearing 56 fixedly mounted to the bottom surface of platform 12 with a pair of rings 57 and 58 formed on main body 54 on the opposite sides of bearing 56 to prevent axial movement of main body 54 along its longitudinal axis with respect to bearing 56. Thus, by rotating tightening means 53, plate 51 is caused to pivot about member 52 thereby moving hook 50 to and from the tree and loosening or tightening line 57.

A collapsable seat 13 includes a seating platform 60 fixedly mounted to a first pair of L-shaped brackets 61 and 62 and to a second pair of L-shaped brackets 63 and 64. A pair of depending legs 65 and 66 are pivotally mounted to bracket 61 and 62 and are rigidly interconnected together by cross-member 67. The bottom ends of legs 65 and 66 are pivotally mounted to a third pair of L-shaped brackets 68 and 69 fixedly attached to the top surface of platform 12. A single leg 70 has a bifurcated top end pivotally attached to brackets 63 and 64 with a free bottom end abuttable atop platform 12. Thus, the seat may be positioned erect such as shown in FIGS. 1 and 2 and may be swung upwardly against the tree to the vertical position such as shown in FIG. 4 thereby allowing the person the full access of the top surface of platform 12. Alternatively, the platform may be swung downwardly in the direction of arrow 70 to be collapsed and extend across the top surface of platform 12 (FIG. 4).

A pair of fabric straps 71 and 72 have opposite ends fixedly attached to the top surface of platform 12 and are positioned in an X fashion thereby forming a shoulder harness to encircle a person's shoulders for carrying the stand when in a collapsed position. Straps 71 and 72 (FIG. 3) extend loosely atop seat 13 when the seat is pivoted in a collapsed position immediately adjacent platform 12. Thus, seating platform 60 is in contact with the person's shoulders with strap 71 and 72 then extending around the front portion of the shoulders and with platform 12 extending down the back of the person. Sections 14 through 16 would be in the collapsed position being located immediately outward of platform 12 and extending down the back of the person carrying the stand.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A portable observation stand comprising:

a collapsible ladder with a base supporting bottom portion and a top portion;

a platform mounted pivotally to said top portion of said ladder and including a tree embracing edge and a top surface;

a flexible line with one end attached to said platform and an opposite free end and having sufficient length to extend around a tree;

tightening means engagable with said free end of said line and operable to pull said line tight to force said tree embracing edge against a tree;

platform erecting means mounted on said ladder and engagable with said platform operable to hold said platform horizontally until secured to a tree by said line and tightening means;

said ladder when erected includes a vertically extending pole with outwardly extending footholds, said pole including multiple sections pivotally connected together and collapsible against said platform when in a stored position;

said sections include a pair of aligned and adjacent sections having arms extending outwardly and pivotally interconnected with one of said pair of sections having a first pin receiving hole and the other having a first tab with aperture alignable with said hole when said sections are erected, said ladder including a first pin removable extendable through said aperture and hole to secure said pair of sections together;

said tightening means includes a threaded member rotatably mounted to said platform and a hook engagable with said line and pivotally mounted to said platform, said threaded member is operably engaged with said hook to pull said line past said tree embracing edge with said edge and line gripping said tree therebetween;

said sections include a third section aligned and adjacent one section of said pair of sections with a second tab and second pin securing said third section to said one section of said pair, said second tab and said second pin located on a side of said ladder opposite said first pin and said first tab stabilizing said ladder when erected;

a seat with a pair of rear legs pivotally attached thereto and extending downwardly and pivotally mounted to said platform adjacent said tree embracing edge and further including one front leg pivotally mounted to said seat and abuttable atop and against said platform.

2. The portable observation stand of claim 1 wherein said platform erecting means includes an arm with a bottom end pivotally mounted to said ladder and a top end swingable up against and beneath said platform.

3. A portable observation stand comprising:

a collapsible ladder with a base supporting bottom portion and a top portion;

a platform mounted pivotally to said top portion of said ladder and including a tree embracing edge and a top surface;

a flexible line with one end attached to said platform and an opposite free end and having sufficient length to extend around a tree;

tightening means engagable with said free end of said line and operable to pull said line tight to force said tree embracing edge against a tree;

a shoulder harness mounted to said platform to encircle a person's shoulders for the carrying of the stand when in a collapsed position;

said tightening means includes a threaded member rotatably mounted to said platform and a hook engagable with said line and pivotally mounted to said platform, said threaded member is operably engaged with said hook to pull said line past said tree embracing edge with said edge and line gripping said tree therebetween;

a seat with a pair of rear legs pivotally attached thereto and extending downwardly and pivotally mounted to said platform adjacent said tree embracing edge and further including a front leg pivotally mounted to said seat and abuttable a top and against said platform.

4. The portable observation stand of claim 3 and further comprising platform erecting means mounted on said ladder and engageable with said platform operable to hold said platform horizontally until secured to a tree by said line and tightening means.

5. The portable observation stand of claim 4 wherein said platform erecting means includes an arm with a bottom end pivotally mounted to said ladder and a top end swingable up against and beneath said platform.

6. The portable observation stand of claim 5 wherein said ladder when erected includes a vertically extending pole with foot holds, said pole includes multiple sections pivotally connected together and collapsible against said platform when in a stored position, said sections include a pair of aligned and adjacent sections pivotally interconnected with one of said pair of sections having a first pin receiving hole and the other having a first tab with aperture alignable with said hole when said sections are erected, said ladder including a first pin removably extendable through said aperture and hole to secure said pair of sections together;

said sections include a third section aligned and adjacent one section of said pair of sections with a second tab and second pin securing said third section to said one section of said pair, said second tab and said second pin located on a side of said ladder opposite said first pin and said first tab stabilizing said ladder when erected.

* * * * *